US012187964B2

(12) United States Patent
Soderberg et al.

(10) Patent No.: US 12,187,964 B2
(45) Date of Patent: Jan. 7, 2025

(54) AMELIORATION OF SOLIDS FORMATION IN SPENT HYDROGEN SULFIDE SCAVENGERS

(71) Applicant: CANADIAN ENERGY SERVICES L.P., Calgary (CA)

(72) Inventors: Jeffrey Soderberg, Calgary (CA); David Horton, Calgary (CA); Hossein Jozani, Calgary (CA)

(73) Assignee: Canadian Energy Services L.P., Calgary (CA)

( * ) Notice: Subject to any disclaimer, the term of this patent is extended or adjusted under 35 U.S.C. 154(b) by 23 days.

(21) Appl. No.: 18/306,825

(22) Filed: Apr. 25, 2023

(65) Prior Publication Data

US 2023/0340339 A1 Oct. 26, 2023

Related U.S. Application Data

(60) Provisional application No. 63/353,157, filed on Jun. 17, 2022, provisional application No. 63/334,536, filed on Apr. 25, 2022.

(51) Int. Cl.
*C10G 21/20* (2006.01)
*C10G 29/20* (2006.01)

(52) U.S. Cl.
CPC ..... *C10G 21/20* (2013.01); *C10G 2300/207* (2013.01)

(58) Field of Classification Search
CPC ..... C04B 20/023; C04B 2103/0088; C04B 28/04; C04B 7/26; C04B 7/345; C04B 7/43; C04B 7/47; C04B 18/08; C04B 18/141; Y02P 40/10; Y02P 40/121; Y02P 40/18; Y02W 30/91; C10G 21/20; C10G 2300/207; C10G 29/20
See application file for complete search history.

(56) References Cited

U.S. PATENT DOCUMENTS

| | | | | |
|---|---|---|---|---|
| 5,347,004 | A | 9/1994 | Rivers et al. | |
| 5,554,349 | A | 9/1996 | Rivers et al. | |
| 6,582,624 | B2 | 6/2003 | Titley et al. | |
| 2013/0004393 | A1* | 1/2013 | Menendez | B01D 53/52 210/749 |
| 2021/0198129 | A1* | 7/2021 | Maltas | C02F 1/683 |

OTHER PUBLICATIONS

Sulfaguard 4563 H2S Scavenger—Brenntag Canada (WIL-Chem Stanchem Travis) Safety Data Sheet, May 28, 2018.

(Continued)

*Primary Examiner* — Ellen M McAvoy
*Assistant Examiner* — Chantel Graham
(74) *Attorney, Agent, or Firm* — Bennett Jones LLP

(57) ABSTRACT

A method and composition is described for reducing the levels of hydrogen sulfide in a fluid such as a hydrocarbon stream. The method involves contacting the gas stream with a composition comprising a mixture of amines reacted with formaldehyde. The composition reduces the formation and deposition of solids commonly associated with spent triazine scavengers.

14 Claims, 2 Drawing Sheets

(56) References Cited

OTHER PUBLICATIONS

Taylor et al., Amorphous Polymeric Dithiazine apDTZ Solid Fouling: Critical Review,Analysis and Solution of an Ongoing Challenge in Triazine-Based HydrogenSulphide Mitigation, Society of Petroleum Engineers, SPE-204397-MS, Dec. 2021, pp. 1-15, The Woodlands, Texas, USA.

Wylde et al., Formation, Chemical Characterization, and Oxidative Dissolution of Amorphous Polymeric Dithiazine (apDTZ) during the Use of the H2S Scavenger Monoethanolamine-Triazine, Heriot-Watt University Research Gateway, Energy and Fuels, vol. 34, No. 8, pp. 9923-9931, https://doi.org/10.1021/acs.energyfuels.0c01402, Jul. 31, 2020.

Matherly et al., The Evaluation and Optimization of Hydrogen Sulfide Scavenger Applications Using Ion Mobility Spectrometry, Society of Petroleum Engineers, SPE 164133, Apr. 2013, pp. 1-10, The Woodlands, Texas, USA.

Taylor et al., The Formation and Chemical Nature of Amorphous Dithiazine Produced From Use of Hexahydrotriazine Based Hydrogen Sulfide Scavengers and the Use of an Alternative Scavenger to Minimize Solid Formation in Sour Gas Applications, Society of Petroleum Engineers, SPE 164134, Apr. 2013, pp. 1-14, The Woodlands, Texas, USA.

Taylor et al., The Laboratory Evaluation and Optimization of Hydrogen Sulphide Scavengers Using Sulphur Specific Flame Photometric Gas Chromatography, Society of Petroleum Engineers, SPE 140401, Apr. 2011, pp. 1-11, The Woodlands, Texas, USA.

Taylor et al., Identification of the Molecular Species Responsible for the Initiation of Amorphous Dithiazine Formation in Laboratory Studies of 1,3,5-Tris (hydroxyethyl)-hexahydro-s-triazine as a Hydrogen Sulfide Scavenger, Industrial & Engineering Chemistry Research, American Chemical Society, Aug. 2, 2012, 51, pp. 11613-11617, Texas, USA.

Taylor et al., Use of Portable Analytical Methods to Determine the Stoichiometry of Reaction for Hexahydrotriazine-Based Hydrogen Sulfide Scavenger Operations, Analytical Chemistry, American Chemical Society, Apr. 28, 2014, 86, 4879-4882, Texas, USA.

Taylor et al., Progress Towards an Oil and Gas Industry Alternative to Mea Triazine in Hydrogen Sulfide Mitigation, Society of Petroleum Engineers, SPE-191566-MS, Sep. 2018, pp. 1-14, Dallas, Texas, USA.

* cited by examiner

AMELIORATION OF SOLIDS FORMATION IN SPENT HYDROGEN SULFIDE SCAVENGERS

FIELD

The invention relates to chemical compositions for reaction with hydrogen sulfide.

BACKGROUND

The hydrogen sulfide content of a fluid from an oil and gas well has an important impact on the economic value of the produced hydrocarbons and productions operations. Hydrogen sulfide is dangerous to personnel as it is extremely toxic to humans. In addition, hydrogen sulfide is extremely corrosive to most metals. It can cause corrosion problems to drill strings, transport pipelines, storage tanks, and other metal components. It causes sulfide stress cracking, hydrogen embrittlement and pitting corrosion in oil and gas operations.

The removal of hydrogen sulfide from oil and gas streams is often required in order to meet many pipeline and storage regulations. A number of processes are available to remove hydrogen sulfide from hydrocarbon streams using chemical agents. These chemical agents react with one or more sulfide species and convert them to a more inert form. These chemical agents are known in the industry as hydrogen sulfide ($H_2S$) scavengers. Hydrogen sulfide scavengers can be in a solid or liquid form. Liquid scavengers may be (i) regenerative scavengers such as amine wash or reduction oxidation or (ii) non-regenerative scavengers such as aldehydes, triazines, and sodium nitrates, as examples. When the hydrogen sulfide concentration is low, non-regenerative liquid scavengers are often used. A large number of non-regenerative chemical formulations exist for removal of hydrogen sulfide.

One important group and the most frequently used liquid hydrogen sulfide scavengers are hexahydrotriazine-based hydrogen sulfide scavengers. These are commonly referred to in the industry as triazine scavengers. Triazines are readily deployed in scrubbers and are effective scavengers. Triazine is a heterocyclic structure similar to cyclohexane but with three carbons replaced by nitrogen atoms. The most common triazines used as hydrogen sulfide scavengers are those based on monoethanolamine (MEA triazine) or methyl amine (MMA triazine).

Triazines are the reaction products of three moles of amine with three moles of formaldehyde. For certain hydroxyalkyl amines, reaction of three moles of formaldehyde with two moles of a hydroxyalkyl amine followed by dehydration can result in a biscyclized bridged moiety. As an example, three moles of formaldehyde reacted with two moles of isopropanolamine produces bisoxozolidine (oxazolidine, 3,3'-methylenebis[5-methyl-]). Note that in aqueous solution, the bisoxozolidine behaves as if it were isopropanolamine triazine with an excess of formaldehyde. Thus, herein bisoxozolidine is encompassed by "triazine".

In one example, a liquid hydrogen sulfide scavenger, such as triazine, is used in a contactor tower or scrubber. The hydrocarbon feed gas is bubbled through the contactor, while it is filled with an aqueous fluid containing triazine. As the hydrocarbon gas bubbles up through the aqueous based fluid, the hydrogen sulfide reacts with the triazine and the hydrogen sulfide is removed from the hydrocarbon gas stream.

The main byproducts when reacting two moles of hydrogen sulfide with triazine are dithiazine and the precursor amine of the triazine. In a contactor tower, dithiazine forms a separate liquid phase or layer, which over time can precipitate out of solution or separate into a second phase followed by formation of solids below the melting point of the dithiazine. Based on research, dithiazine solids appear to arise from both crystallization and polymerization, resulting in crystalline solids and amorphous solids, respectively.

Dithiazine solids are difficult to remove and can buildup in gas processing equipment. In bubble or contactor towers, dithiazine solids can plug the spent scavenger outlet lines or the spent scavenger chemical storage tanks. Dithiazine solids can also cause problems in tank trucks and potentially cause plugging in disposal wells. The quality or solids content of the spent scavenger can determine the method and cost of disposal. Extensive cost and resources are used in cleaning gas processing equipment and disposal of spent triazine scavengers containing dithiazine solids.

There has been some prior work done to examine and mitigate solids formation in spent triazine based scavengers. It is disclosed in U.S. Pat. No. 6,582,624 B2 (Titley et al.) that a mixture comprising the reaction product of monethanolamine, diglycolamine, and formaldehyde can alleviate problems associated with crystalline dithiazine solids buildup. It is suggested that the addition of diglycolamine lowers the freezing point of the spent hydrogen sulfide scavenger. While the spent reaction product typically does not contain crystalline dithiazine, there still exists the presence of amorphous scavenger solids.

In U.S. Pat. Nos. 5,347,004 and 5,554,349 (Rivers et al.), the use of a mixture containing alkoxyalkylene amine, ammonia and dialkylamine with formaldehyde are shown to effectively scavenge hydrogen sulfide. However, there is no indication that the mixture will mitigate the formation of dithiazine solids.

Despite the widespread use of MEA triazine in industry and the research to try to understand the reaction products of MEA triazine with hydrogen sulfide, there remains a need for a triazine composition that will effectively reduce or eliminate the formation of dithiazine solids.

SUMMARY

In one aspect of the present invention, there is provided a new hydrogen sulfide scavenger composition comprising a mixture of amines reacted with formaldehyde. In a method for scavenging hydrogen sulfide from a fluid stream, this composition reduces dithiazine solids generation over a method using a triazine hydrogen sulfide scavenger reacted from a single amine, such as for example MEA triazine, alone.

In accordance with one exemplary embodiment, there is provided a method of scavenging hydrogen sulfide from a fluid stream, the method comprising: contacting the fluid stream with a hydrogen sulfide scavenging composition comprising mixed amines reacted with formaldehyde.

In accordance with another exemplary embodiment, there is provided a method of ameliorating spent solids formation in a hydrogen sulfide scavenging system, the method comprising: employing a hydrogen sulfide scavenging composition that is a reaction product from mixed amines and formaldehyde.

In accordance with another exemplary embodiment, there is provided a hydrogen sulfide scavenging composition comprising: a triazine according to Formula I:

Formula I

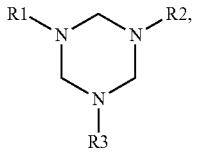

defined as a mixed triazine where R1, R2 and R3 are each independently selected from alkyl, ether, alkaryl or alkylhydroxy radicals and where R1, R2 and R3 are not all the same.

In accordance with another exemplary embodiment, there is provided a hydrogen sulfide scavenging composition comprising: a mixture of two or more different compounds selected from the group consisting of:

(i) a triazine according to the formula I and defined as a pure triazine where R1, R2 and R3 are all the same and are alkyl, ether, alkaryl or alkylhydroxy radicals;

(ii) a mixed triazine; and (iii) a bisoxozolidine.

It is to be understood that "triazine", "triazine-based scavenger" and the like terms, include bisoxozolidines.

DETAILED DESCRIPTION OF THE INVENTION

Figure 1:
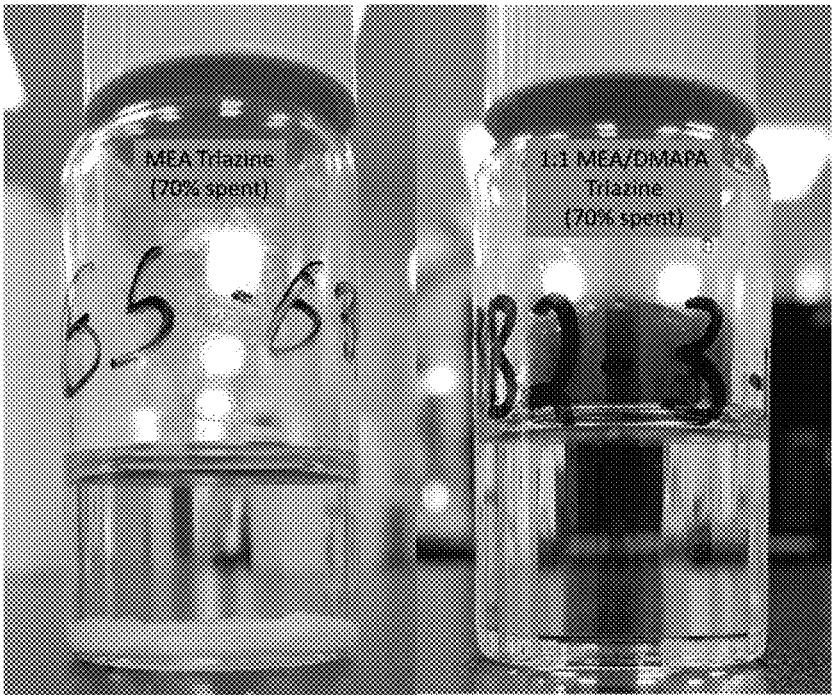
FIG. 1 is a photo of MEA triazine and 1:1 MEA/DMAPA triazine scavengers after spending with $H_2S$ to 70% of the theoretical capacity.

In one embodiment, the present invention provides a new hydrogen sulfide scavenger composition comprising mixed amines reacted with formaldehyde.

The present invention provides a hydrogen sulfide scavenging composition that effectively scavenges hydrogen sulfide from fluids such as aqueous fluids or liquid and gaseous hydrocarbon streams, while minimizing or eliminating the formation of spent scavenger solids.

In a first aspect, the hydrogen sulfide scavenger composition comprises the reaction product of formaldehyde and a mixture of amines. As noted above, the reaction product of three moles of amine with three moles of formaldehyde is a triazine. The general formula for triazine is as follows:

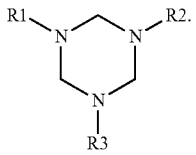

Herein, substituents R1, R2 and R3 are each selected from alkyl, ether, alkaryl or alkylhydroxy radicals. Thus, mixed amines reacted with formaldehyde produces a composition including:

(a) a mixed triazine, for example, mixed amine hexahydrotriazine. A mixed triazine is according to the above formula where R1, R2 and R3 are not all the same. In other words, where R1 is a different substituent than the substituents R2 and/or R3; and/or (b) a mixture of triazines, which means a mixture of two different triazines. In a mixture of triazines, there is at least a first triazine and a second triazine, each according to the above formula, and at least one of substituents R1, R2 and R3 in the first triazine is different than the R1, R2 and R3 of the second triazine. This mixture of triazines can be selected from: two or more mixed triazines, two or more pure triazines (R1═R2═R3) or mixtures of one or more mixed triazine and one or more pure triazine. Each triazine in the mixture of triazines has a concentration of 0.1-99.9 mol %. For example, in an embodiment with two or more pure triazines, each of the pure triazines is present in the mixture at 0.1-99.9 mole %. To be clear, the mixture of triazines can include a bisoxozolidine (oxazolidine, 3,3'-methylenebis[5-methyl-]) and at least one triazine according to the above formula, where the triazine is either mixed or pure. This is noted specifically, but it is again confirmed that herein bisoxozolidine is encompassed by "triazine" due to the fact that bisoxozolidine behaves as a triazine with an excess of formaldehyde.

In one embodiment, the composition is based on amines N—R1, N—R2 and N—R3 selected from alkylamines, ether amines, alkaryl amines or alkylhydroxy amines. In embodiments, the N—R1, N—R2 and N—R3 are selected from alkyl amines (C1-C5), ethanolamine, dimethylaminopropylamine, isopropanolamine, aniline, cyclohexylamine, isobutanolamine and methoxypropylamine, where the molar ratio of each N—R1, N—R2 and N—R3 is 0.1-99.9%.

For example, the composition may be (a) or (b) above, where N—R1, N—R2 and N—R3 includes at least two of alkyl amines (C1-C5), ethanolamine, dimethylaminopropylamine, isopropanolamine, aniline, cyclohexylamine, isobutanolamine or methoxypropylamine, each N—R1, N—R2 and N—R3 present from around 0.1-99.9 mole %.

In the composition, there may be free formaldehyde present.

The above noted reaction products of mixed amines and formaldehyde can be produced from combining two different amines with formaldehyde, combining two different triazines, or adding an amine to a triazine. Of course, in the case of adding an amine to a triazine, if the triazine is a pure triazine, then the amine to be added is of course different than the amine of the pure triazine. The reactants need not be added simultaneously or in any particular order. For example, it is just as effective to add a first triazine to a solution of a second triazine, as it is to add formaldehyde to a mixture of two or more amines or to add one or more amines to an existing triazine. Where the reaction product is obtained by reacting amines with formaldehyde, the formaldehyde could be present in excess. Where the amines are added to a triazine, excess amine forms one of the compounds noted above in a) and b).

The above described hydrogen sulfide scavenger composition comprising mixed amines reacted with formaldehyde is useful for scavenging hydrogen sulfide from a fluid stream. For example, a method for scavenging hydrogen sulfide from a fluid stream or a method for ameliorating solids formation in an $H_2S$ scavenger uses a composition comprising mixed amines reacted with formaldehyde, which as noted above is a mixed triazine or a mixture of triazines. The triazines are as shown in the above formula, where R1, R2 and R3 are each selected from alkyl, ether, alkaryl or alkylhydroxy radicals and R1, R2 and R3 are present from around 0.1-99.9 mole % and optionally, 0.1-99.9 mole % bisoxozolidine. The methods include contacting the fluid stream with the composition. The fluid stream may be a hydrocarbon fluid stream, for example.

In another embodiment, a method scavenging hydrogen sulfide or a method of ameliorating solids formation in a hydrogen sulfide scavenger adds one or more amines selected from the group consisting of: alkyl amines (C1-C5), ethanolamine, dimethylaminopropylamine, isopropanolamine, aniline, cyclohexylamine, isobutanolamine and methoxypropylamine to a triazine as listed in the above formula or bisoxozolidine, provided the one or more amines are different than any amine groups of the triazine or bisoxozolidine.

In another aspect of the invention, the mixture of amines may include monoethanolamine and/or methyl amine in addition to one or more other amines. As such, the composition may contain at least a reaction product of monoethanolamine and formaldehyde (which is hexahydro-1,3,5-tris (hydroxyethyl)-s-triazine) and/or a reaction product of methyl amine and formaldehyde. In one possible embodiment, the monoethanolamine and/or methyl amine constitutes greater than or equal to 50 mol percent of the total amine content of the mixture. In such an embodiment, the molar ratio of monoethanolamine and/or methyl amine to all other amines used as reactants may be up to 1:0.1.

In one aspect, the one or more other amines are primary, secondary, or tertiary amines such as, but not limited to, the other of monoethanolamine or methyl amine, other alkyl amines (C2-C5), another ethanolamine, dimethylaminopropylamine, isopropanolamine, aniline, cyclohexylamine, isobutanolamine and methoxypropylamine. If these others are used where the monoethanolamine and/or methyl amine comprises greater than or equal to 50 mol percent of the total amine content of the mixture, then these one or more other amines will constitute less than or equal to 50 mol percent of the total amine content of the composition.

The molar ratio of total amines to formaldehyde may be from 1:10 to 10:1. In one embodiment, the molar ratio of total amines to formaldehyde be in the range of 1:3 to 1.2:1.

In considering the molar ratio of total amines to formaldehyde, it is to be understood that the noted ratios refer to the amount of amines and formaldehyde that are mixed together and not necessarily the amount of amine and formaldehyde that forms a reaction product.

In one aspect, the one or more amines are neither alkoxyalkylene amines nor diglycolamines. In one embodiment, for example, the mixture of amines may not include alkoxyalkylene amines and diglycolamines. Some alkoxyalkylene amines and diglycolamines have been found not to mitigate solids formation in hydrogen sulfide scavenging systems. Further, many alkoxyalkylene amines and diglycolamines do not meet the regulatory requirements for use as scavengers.

To summarize, then, the invention relates to a reaction product of a mixture of at least two different amines and formaldehyde. The reaction product can be used as a scavenger for $H_2S$, and in so doing solids formation in the spent scavenger is ameliorated. Methods for using the reaction product are also proposed. It is noted that:

i. The reaction product can be a mixture of two or more different compounds selected from the group consisting of: pure triazines, mixed triazines and bisoxozolidines;

or ii. The reaction product can be a mixed triazine. A mixed triazine has been found to accomplish the same effect as mixing pure triazines. For example, isopropanolamine triazine with MEA is a useful mixed triazine.

To be clear, bisoxozolidine can be used as a substitute for a triazine.

The reaction product can be prepared in any sequence. For example, two triazines can be combined or one or more amines can be added to a triazine (already formed) to get the same effect as reacting the amines with formaldehyde.

While the formaldehyde and amines are the reactants of interest in this invention, it will be appreciated that a hydrogen sulfide scavenger composition may contain other chemicals such as methanol, glycol, etc.

EXAMPLES

Example I—Four Scavenger Compositions were Prepared

I. Monoethanolamine and formaldehyde (referred to as MEA-triazine);

II. 95% monoethanolamine-triazine and 5% dimethylaminopropylamine-triazine (referred to as 5% DMAPA);

III. 95% monoethanolamine-triazine and 5% methyl amine-triazine (referred to as 5% MMA); and IV. 95% monoethanolamine-triazine and 5% isopropanolamine-triazine (referred to as 5% MIPA).

A 50 mL volume of each scavenger was transferred into an autoclave. The autoclave was then sealed and charged with pure $H_2S$ at a calculated pressure for 80% or 90% spent. The scavengers were stirred at high rotational speed at room temperature for 3 hours, which was enough time to complete the reaction of the $H_2S$ with the scavenger solutions. Reaction completeness was determined by observing a lowering of the autoclave pressure down to zero. The partially spent scavengers were poured into glass bottles and kept at 0° C. for 10 days. The aged scavenger solutions were then filtered using Whatman filter paper grade 1 and the removed solids were weighed after being dried inside an oven.

The percentage of solids reduction in each scavenger are shown in the Table 1.

TABLE 1

Solids reduction in 80% or 90% spent scavenger solutions at 0° C. for 10 days

| Base Chemistry | Second Amine | Level of Spent (%) | Temperature (° C.) | Solids Reduction (%) |
|---|---|---|---|---|
| MEA-Triazine | 5% DMAPA | 80 | 0 | 35.1 |
| | 5% MMA | | | 51.9 |
| | 5% MIPA | | | 33.8 |
| | 5% DMAPA | 90 | | 20.8 |
| | 5% MMA | | | 22.1 |
| | 5% MIPA | | | 19.5 |

At 80% spent, the 5% MMA substituted triazine was the best performer and reduced solids formation by ~52%. At 90% spent, the 5% MMA substituted triazine still reduced solids by over 22%.

Example II

MEA-triazine and 1:1 MEA/DMAPA mixed triazine scavengers were spent with $H_2S$ to 70% of the theoretical capacity. The spent scavengers are shown in FIG. 1. These results show that the mixed amines substantially eliminate the formation of all spent scavenger solids—both crystalline solids and amorphous solids.

Example III

Figure 2:
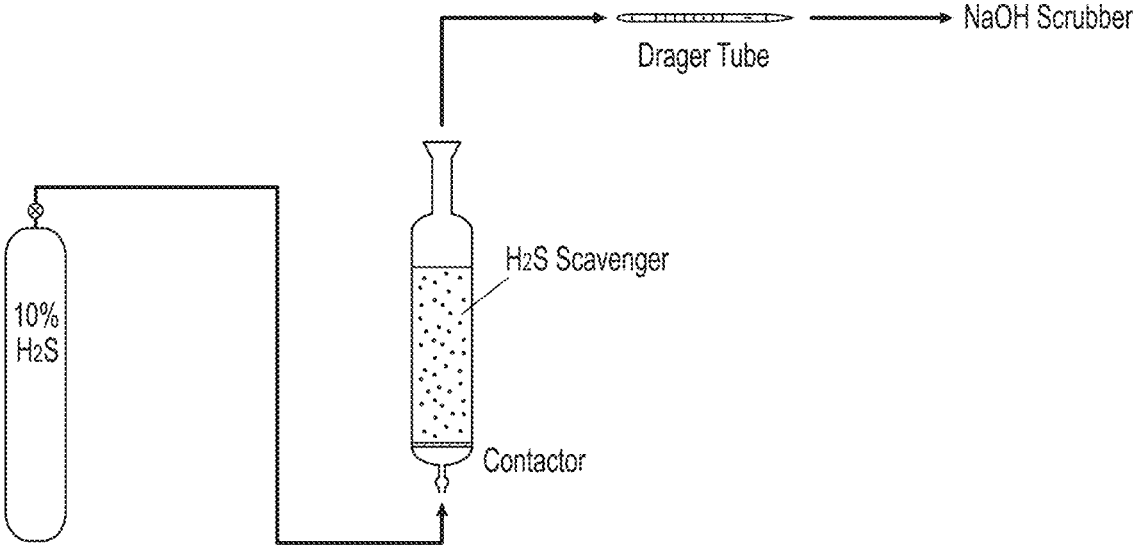
FIG. 2 is a schematic of the laboratory $H_2S$ breakthrough test apparatus used for performance testing of selected scavenger blends.
Figure 3:
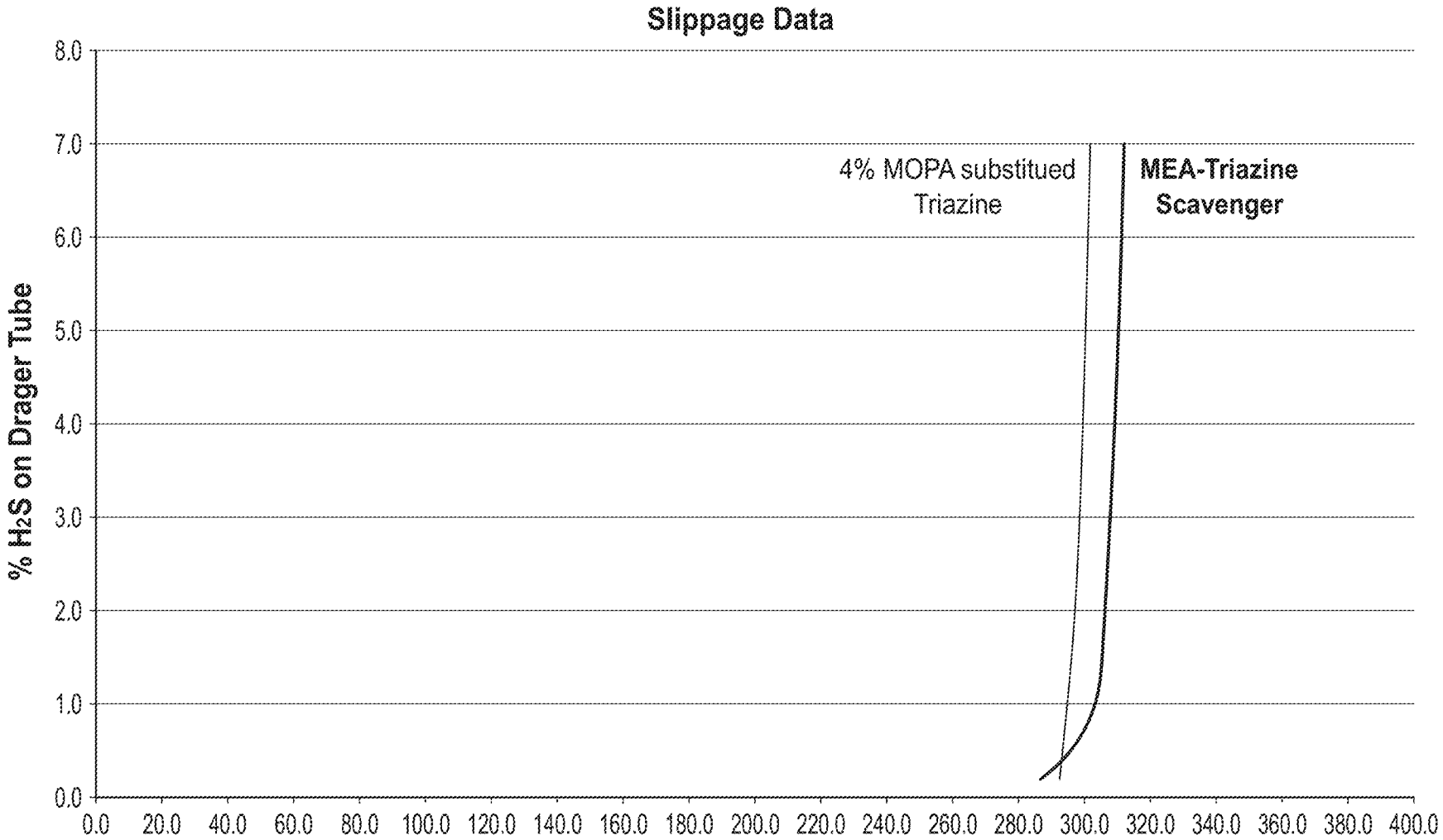
FIG. 3 is a graph of the cumulative $H_2S$ concentration measured in the outlet gas from the scavenger contactor of the apparatus of FIG. 2.

With reference to FIG. 2, for performance testing of the selected blends, a 50 mL sample of the $H_2S$ scavenger of interest is put in the contactor of the breakthrough apparatus. The sample is purged with a gas mixture containing 10% $H_2S$ (in Nitrogen) at a flow rate of 211 mL/min. The scavenged gas is then passed through a Drager tube. In this test, the "breakthrough time" is reported as the time required until the 0.2% (2000 ppm) reading level is reached on the Drager tube. Once breakthrough is observed, the test continues until the 7% reading on the Drager tube is reached. Results for performance testing of a pure MEA-triazine sample and a mixture of a 96% monoethanolamine-triazine and 4% methoxypropylamine-triazine (referred to as a 4% MOPA) are shown in FIG. 3.

CLAUSES

The invention may be directed to:

A. A hydrogen sulfide scavenging composition comprising the reaction product of mixed amines and formaldehyde.

B. The composition according to clause A wherein production of spent hydrogen sulfide scavenger solids is reduced compared to the production of spent hydrogen sulfide scavenger solids of a scavenger composition comprising a single form of R1═R2═R3 triazine.

C. The composition of clause A or clause B with the proviso that the mixed amines are neither alkoxyalkylene amines nor diglycolamines.

D. The composition according to any of the preceding clauses wherein the molar ratio of the mixed amines to the formaldehyde is from 1:10 to 10:1.

E. The composition according to any of the preceding clauses wherein the molar ratio of the mixed amines to the formaldehyde is from 1:3 to 1.2:1.

F. The composition according to any of the preceding clauses wherein the mixed amines are primary, secondary, or tertiary amines.

G. The composition according to any of the preceding clauses wherein the mixed amines include one or more of: alkyl amines (C1-C5), ethanolamine, dimethylaminopropylamine, isopropanolamine, aniline, cyclohexylamine, isobutanolamine and methoxypropylamine.

H. The composition according to any of the preceding clauses wherein a first amine component of the mixed amines is monoethanolamine and/or methyl amine and the molar ratio of monoethanolamine and/or methyl amine to other amines is up to 1:1.

I. The composition according to clause H wherein the molar ratio of monoethanolamine and/or methyl amine to the other amines up to 1:0.1.

J. The composition according to clause H, wherein the mix monoethanolamine is a predominant amine and there is a minor amount of methoxypropylamine (MOPA).

K. The composition according to any of the preceding clauses, further comprising free formaldehyde.

L. A method for scavenging hydrogen sulfide from a hydrocarbon-containing stream, comprising: passing the hydrocarbon-containing stream into contact with a composition according to any one of clauses A-M.

M. A method of ameliorating solids formation in an hydrogen sulfide scavenging system, comprising: employing a scavenger comprising a mixed triazine according to the formula

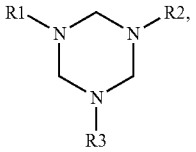

where R1, R2 and R3 are each alkyl, alkoxy, alkaryl or alkylhydroxy radicals and R1, R2 and R3 are present from around 0.1-99.9 mole %.

N. The method of clause O, where N—R1, N—R2 and N—R3 are each independently selected from alkyl amines (C1-C5), ethanolamine, dimethylaminopropylamine, isopropanolamine, aniline, cyclohexylamine, isobutanolamine and methoxypropylamine and are present from around 0.1-99.9 mole %, and wherein the composition may comprise 0.1-99.9 mole % oxazolidine, 3,3'-methylenebis[5-methyl].

O. The method according to clauses M or N where free formaldehyde is present.

P. A mixture of pure triazines, where each pure triazine is according to the formula

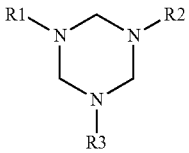

and R1═R2═R3, where each of the pure triazines is present from around 0.1-99.9 mole %, which may include 0.1-99.9 mole % oxazolidine. 3,3'-methylenebis[5-methyl].

Q. The mixture of clause P used as a hydrogen sulfide scavenger and optionally further comprising free formaldehyde.

R. A method of ameliorating solids formation by adding an amine selected from the group consisting of: alkyl amines (C1-C5), ethanolamine, dimethylaminopropylamine, isopropanolamine, aniline, cyclohexylamine, isobutanolamine and methoxypropylamine to a triazine, wherein the amine is different than an amino substituent of the triazine.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A method of ameliorating spent solids formation in a hydrogen sulfide scavenging system, the method comprising: employing a hydrogen sulfide scavenging composition that is a reaction product from mixed amines and formaldehyde.

2. The method of claim 1, wherein the mixed amines are at least two different amines selected from C1-C5 alkyl amines, ethanolamine, dimethylaminopropylamine, isopropanolamine, aniline, cyclohexylamine, isobutanolamine or methoxypropylamine.

3. The method of claim 2 wherein the reaction product is:

(A) a mixed triazine; or (B) a mixture of two or more different compounds selected from the group consisting of: (i) a pure triazine, (ii) a mixed triazine, and (iii) a bisoxozolidine.

4. The method of claim 3, wherein the reaction product is (B) and each of the two or more different compounds has a concentration of 0.1-99.9 mole %.

5. The method of claim 4, wherein the two or more different compounds are each pure triazines.

6. The method of claim 1 wherein the composition further comprises free formaldehyde.

7. The method of claim 1 further comprising: producing the hydrogen sulfide scavenging composition by adding a selected amine, selected from the group consisting of: C1-C5 alkyl amine, ethanolamine, dimethylaminopropylamine, isopropanolamine, aniline, cyclohexylamine, isobutanolamine and methoxypropylamine, to a triazine reacted from a single amine, wherein the selected amine is different than the single amine.

8. The method of claim 1, wherein an amount of solids generated in the hydrogen sulfide scavenging composition when spent is less than an amount of spent solids generated from a scavenger that is a reaction product of a single amine and formaldehyde.

9. The method of claim 1, wherein the hydrogen sulfide scavenging composition consists of a reaction product from mixed amines and formaldehyde.

10. A method for ameliorating spent solids formation in a hydrogen sulfide scavenging system, the method comprising: scavenging hydrogen sulfide in a hydrogen sulfide scavenging composition that is:

(A) a triazine according to Formula I:

Formula I

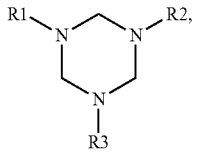

defined as a mixed triazine where R1, R2 and R3 are each independently selected from alkyl, ether, alkaryl or alkylhydroxy radicals and where R1, R2 and R3 are not all the same; or (B) a mixture of two or more different compounds selected from the group consisting of:

(i) a triazine according to the formula I and defined as a pure triazine where R1, R2 and R3 are all the same and are alkyl, ether, alkaryl or alkylhydroxy radicals;

(ii) a mixed triazine; and (iii) a bisoxozolidine.

11. The method of claim 10, wherein the alkyl, ether, alkaryl or alkylhydroxy radicals are derived from C1-C5 alkyl amines, ethanolamine, dimethylaminopropylamine, isopropanolamine, aniline, cyclohexylamine, isobutanolamine or methoxypropylamine.

12. The method of claim 10, according to (B) wherein the two or more different compounds are each pure triazines.

13. The method of claim 10, wherein an amount of solids generated in the hydrogen sulfide scavenging composition when spent is less than an amount of spent solids generated from a scavenger that is a pure triazine alone.

14. The method of claim 10, wherein the hydrogen sulfide scavenging composition consists of (A) or (B).

* * * * *